US011399630B2

(12) United States Patent
Hu

(10) Patent No.: US 11,399,630 B2
(45) Date of Patent: Aug. 2, 2022

(54) FOLDABLE STOOL

(71) Applicant: Ninghai Xingda Leisure Products Co., Ltd., Shenzhen Town (CN)

(72) Inventor: Jinxue Hu, Shenzhen Town (CN)

(73) Assignee: Ninghai Xingda Leisure Products Co., Ltd., Shenzhen (CN)

( * ) Notice: Subject to any disclaimer, the term of this patent is extended or adjusted under 35 U.S.C. 154(b) by 0 days.

(21) Appl. No.: 17/212,535

(22) Filed: Mar. 25, 2021

(65) Prior Publication Data

US 2021/0368986 A1 Dec. 2, 2021

(30) Foreign Application Priority Data

May 27, 2020 (CN) ..... 202010458944.9

(51) Int. Cl.

| | |
|---|---|
| ***A47C 4/24*** | (2006.01) |
| ***A47C 4/52*** | (2006.01) |
| ***A47C 5/10*** | (2006.01) |
| ***A47C 9/10*** | (2006.01) |
| ***A47B 3/083*** | (2006.01) |
| ***A47B 3/10*** | (2006.01) |
| *A45F 4/02* | (2006.01) |
| *A47B 3/14* | (2006.01) |

(52) U.S. Cl.

CPC ..... *A47C 4/24* (2013.01); *A47B 3/083* (2013.01); *A47B 3/10* (2013.01); *A47C 4/52* (2013.01); *A47C 9/10* (2013.01); *A45F 2004/026* (2013.01); *A47B 2003/145* (2013.01)

(58) Field of Classification Search

CPC .... A47C 4/24; A47C 4/52; A47C 9/10; A47C 4/38; A47C 4/48; A47C 4/283; A47C 4/286; A47C 4/30; A47C 5/10; A47B 3/083; A47B 3/10; A47B 2003/145; A45F 2004/026

USPC ..... 297/17, 56; 108/36, 38, 118, 119, 169, 108/174

See application file for complete search history.

(56) References Cited

U.S. PATENT DOCUMENTS

| | | | | | |
|---|---|---|---|---|---|
| 540,684 | A * | 6/1895 | O'Brien | A47C 4/52 | 297/17 |
| 1,850,636 | A * | 3/1932 | Schauer | A47B 3/10 | 108/35 |
| 2,693,258 | A * | 11/1954 | Fleisch | A47B 3/10 | 190/11 |
| 2,755,153 | A * | 7/1956 | Rachman | A47B 3/083 | 108/35 |
| 2,805,707 | A * | 9/1957 | Schoeppner | A47B 3/14 | 108/38 |

(Continued)

*Primary Examiner* — Robert Canfield
(74) *Attorney, Agent, or Firm* — Wang Law Firm, Inc.

(57) ABSTRACT

A foldable stool has a stool surface and two support legs; the stool surface is made of flexible materials capable of being folded to form a storage compartment; two support legs are swingly connected to each other, the top of two support legs are respectively connected to the left side and right side of a bottom surface of the stool surface; each support leg is hollow inside with an upper section, a middle section and a lower section connected together; an elastic rope runs through inside of each support leg, when the elastic rope is extended, the three sections are separated from each other and rotatably folded into the storage compartment. The stool is simple in structure, light and easy to use and low in cost, easy to carry and also is very beautiful.

7 Claims, 4 Drawing Sheets

(56) References Cited

U.S. PATENT DOCUMENTS

| | | | | | |
|---|---|---|---|---|---|
| 3,279,399 | A * | 10/1966 | White | A47B 3/10 | 108/38 |
| 5,535,683 | A * | 7/1996 | Novak | A47B 3/083 | 190/11 |
| 7,252,040 | B2 * | 8/2007 | Dumond | A47B 23/04 | 108/169 |
| 2006/0049672 | A1 * | 3/2006 | Terrell | A47C 9/10 | 297/17 |
| 2007/0256607 | A1 * | 11/2007 | Friedman | A45C 5/06 | 108/36 |
| 2007/0257540 | A1 * | 11/2007 | Park | A47C 4/38 | 297/451.2 |
| 2010/0116174 | A1 * | 5/2010 | Chen | A47C 19/122 | 108/36 |
| 2022/0015535 | A1 * | 1/2022 | Flynn | A47B 3/083 | |

* cited by examiner

FOLDABLE STOOL

TECHNICAL FIELD OF THE INVENTION

The present invention relates to the technical field of daily necessities, in particular to a foldable stool.

BACKGROUND OF THE INVENTION

Stool is also called taboret which was first used to step on the horse or sedan, so it is also known as split heads or a sedan stool. Stools are made of simple materials and widely used, so the stool is circulated in larger numbers than the chair. Stools have a variety of shapes. It appeared in the early days as a rectangle, which lasted until the Ming Dynasty and became a square in the Qing Dynasty. There are also round, fan-shaped, plum blossom-shaped and hexagonal stools in various forms. In order to carry around conveniently and save space, there are a number of foldable stools at present. Most of the existing foldable stools are provided with a foldable stool surface. During folding, the stool surface is folded in half and the legs are folded crosswise, so that the volume is greatly reduced, but the folded length is not reduced. Especially when it is carried around during traveling, this foldable stool is still not so convenient.

Upon inquiry, a Chinese patent CN210227484U(Patent NO.:201920642840.6), titled Portable Folding Stool, comprises legs which are consisted of multiple first legs and multiple second legs. Rotation gears are disposed at the joints of the first legs and the corresponding second legs, and a stop gear is disposed on one side of the first leg and the second leg, respectively. A support gear is disposed at the top of the first leg while an anti-skid gear is disposed at the bottom thereof. This kind of foldable stool has good stability and long service life, and is not easy to be damaged. However, the folding effect is similar to that of existing foldable stools, which needs further improvement.

SUMMARY OF THE INVENTION

It is an object of the present invention to provide a foldable stool which is simple and reasonable in structure, light in weight and easy to fold, carry around and store.

For achieving the above object, the foldable stool comprises a stool surface having a bottom surface; and two support legs; wherein—the stool surface is made of flexible materials being capable of be folded up to form a storage compartment for receiving the two pairs of support legs; two support legs are swingly connected to each other, the top of two support legs are respectively connected to the left side and right side of the bottom surface of the stool surface; each support leg is hollow inside which composed of an upper section, a middle section and a lower section connected together; an elastic rope runs through inside of each support leg, when the elastic rope is extended, the upper, middle and lower sections of the support leg are separated with each other and rotatably folded into the storage compartment formed by folding the stool surface.

Preferably, each support leg is made of tubes, the upper section and the lower section have U-shape, the middle section is straight and has a top end and a bottom end; two ends of the upper section have a smaller diameter relative to the upper section so as to insert into the top end of each tube of the middle section, and two ends of the lower section have a smaller diameter relative to the lower section so as to insert into the bottom end of each tube of the middle section, accordingly, the upper, middle and lower sections are detachably connected together to form a rectangular frame.

Preferably, a connecting hole is disposed at the middle of each tube of the middle section, the middle section of one support leg is disposed outside of the other support leg, and the middle section of one support leg is rotatably connected to the middle section of the other support leg by two connecting pins inside the connecting holes, so as to make the two support legs be rotatably connected in an X shape.

Preferably, the stool surface is square or rectangular, the stool surface has a lower edge protruding from the bottom surface of the stool surface, and a zipper or a hasp is disposed on the lower edge.

Preferably, the top of the support legs are disposed on the bottom surface of the stool surface and located at the inner side of the lower edge, and a plurality of connecting bands for securing the support legs are disposed adjacent to the lower edge on the bottom surface of the stool surface.

Preferably, the connecting band with two ends is made of flexible materials, one end of the connecting band is fixed with the bottom surface of the stool surface, and the other end of the connecting band is fixed with the bottom surface of the stool surface after going around the upper section of each support leg.

Preferably, each support leg has two elastic ropes with two ends being positioned and fixed by the connecting pins; the two elastic ropes are disposed in two opposite U-shaped routes in the upper, middle and lower sections of each support leg.

Preferably, the lower edge has two slots adjacent to a folding line of the stool surface.

Compared with the prior art, the present invention has the following advantages. The stool surface is made of canvas, chemical fiber, and other flexible materials, which is solid and light. Moreover, the stool surface is also provided with the zipper or hasp at its lower edge, so that it is used as a storage bag after being folded, and zipped or connected with a hasp to form a bag, which is convenient for storage, carrying and use. The support leg is made of tubes and is formed by inserting upper, middle and lower sections into each other, so that the sections are easy to be connected and disengaged. An elastic rope runs through the inner hole of the support leg, which makes the combined support leg not easily disengaged. When the stool needs to be stored, the upper, middle and lower sections are disengaged, rotated and folded, and then put into the storage bag formed by folding the stool surface. According to the present invention, the stool is simple and reasonable in structure, light in weight, easy to fold and low in cost. It greatly reduces the volume and is easy to carry around after being folded and stored, and also is very beautiful.

DETAILED DESCRIPTION OF THE INVENTION

Figure 1:
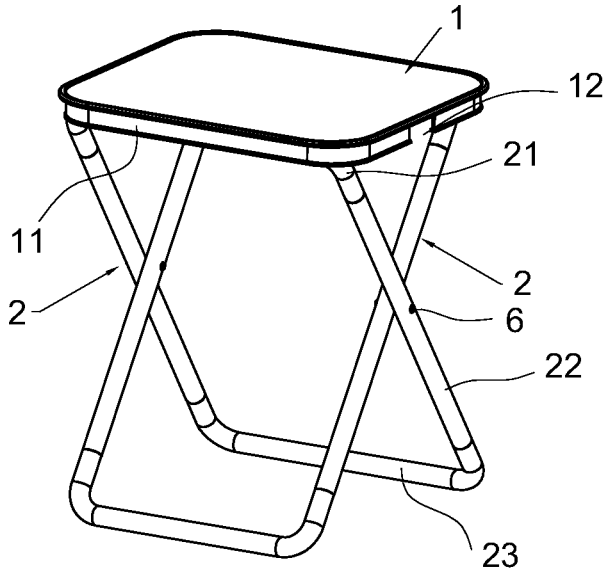
FIG. 1 is a perspective view of a foldable stool according to an embodiment of the present invention.
Figure 2:
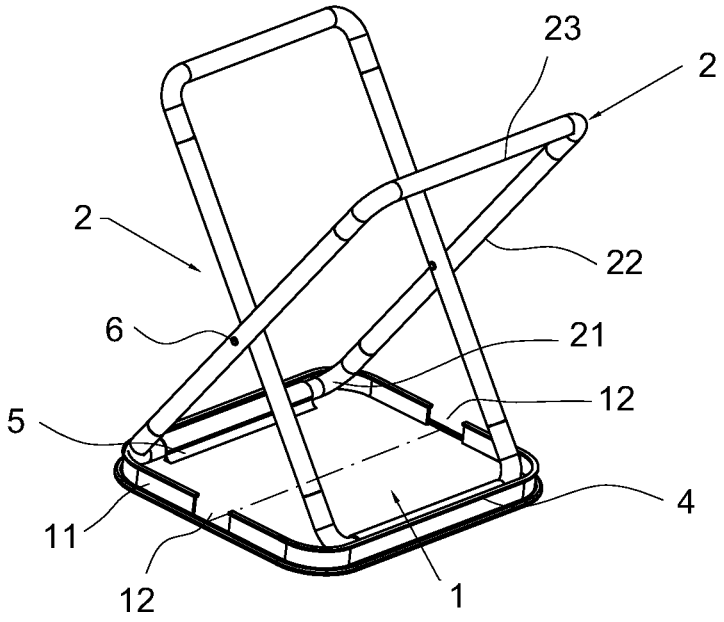
FIG. 2 is a perspective view of the foldable stool in another view according to the embodiment of the present invention.

The present invention will be further described in detail by embodiments with reference to the accompanying drawings.

FIGS. 1-6 show a preferred embodiment of a foldable stool. The foldable stool comprising a stool surface 1 having a bottom surface, and two support legs 2. The stool surface 1 is made of flexible materials being capable of be folded up to form a storage compartment for receiving the two pairs of support legs 2; a plurality of zippers 4 are sewn on faced two edges of the storage bag, so that a bag can be formed. Two support legs 2 are swingly connected to each other, the top of two support legs 2 are respectively connected to the left side and right side of the bottom surface of the stool surface 1 through a plurality of connecting bands or connectors. Each support leg 2 is made of metal tube or composite material tube and is hollow inside which composed of an upper section 21, a middle section 22 and a lower section 23 connected together, and an elastic rope 3 running through inside of each support leg 2 may connect the upper, middle and lower sections 21, 22 and 23 of the support leg 2 together and may also pull the sections apart. Moreover, when the elastic rope is extended, the upper, middle and lower sections 21, 22 and 23 of the support leg 2 are separated with each other and rotatably folded into the storage compartment formed by folding the stool surface 1, and the storage bag is closed by the zipper 4 to form a bag easy to carry around.

The specific structure is as follows: the upper section 21 and the lower section 23 have U-shape, the middle section 22 is straight and has a top end and a bottom end; two ends 211 of the upper section 21 have a smaller diameter relative to the upper section 21 so as to insert into the top end of each tube of the middle section 22, and two ends 231 of the lower section 23 have a smaller diameter relative to the lower section 23 so as to insert into the bottom end of each tube of the middle section 22, accordingly, the upper, middle and lower sections 21, 22 and 23 are detachably connected together, and tightly connected together under the elastic force of the elastic rope 3 to form a roughly rectangular frame, which can make the upper, middle and lower sections 21, 22 and 23 be pulled apart, respectively. Generally, each support leg 2 has two elastic ropes 3 with two ends being positioned and fixed by the connecting pins 6; the two elastic ropes 3 are disposed in two opposite U-shaped routes in the upper, middle and lower sections 21, 22 and 23 of each support leg 2. A connecting hole is disposed at the middle of each tube of the middle section 22, the middle section 22 of one support leg 2 is disposed outside of the other support leg 2, and the middle section 22 of one support leg 2 is rotatably connected to the middle section 22 of the other support leg 2 by two connecting pins 6 inside the connecting holes, so as to make the two support legs 2 be rotatably connected in an X shape. The stool surface 1 is square or rectangular, the stool surface 1 has a lower edge 11 protruding from the bottom surface of the stool surface 1. Generally, the lower edge 11 is sewn and connected to a periphery of the lower surface of the stool surface 1, and may be made of the same flexible material. In order to facilitate folding in half, the lower edge 11 has two slots 12 adjacent to a folding line of the stool surface 1, and further provided with the zipper 4 by sewing. In this way, the peripheries of the storage bag folded will be smooth, which avoids mutual interference and thus makes the bag more fitting and beautiful. Generally, the width of the slot 12 is less than or roughly equal to the sum of two times the height of the lower edge 11 and the height of the zipper 4. The top of the support legs 2 are disposed on the bottom surface of the stool surface 1 and located at the inner side of the lower edge 11, and a plurality of connecting bands 5 for securing the support legs 2 are disposed adjacent to the lower edge 11 on the bottom surface of the stool surface 1. The connecting band 5 can be a canvas band or belt, and there is one or two or even more connecting bands 5. One end of the connecting band 5 is fixed with the bottom surface of the stool surface 1, and the other end of the connecting band 5 is fixed with the bottom surface of the stool surface 1 after going around the upper section 21 of each support leg 2, and may also be fixed by stitching or riveting.

Figure 3:
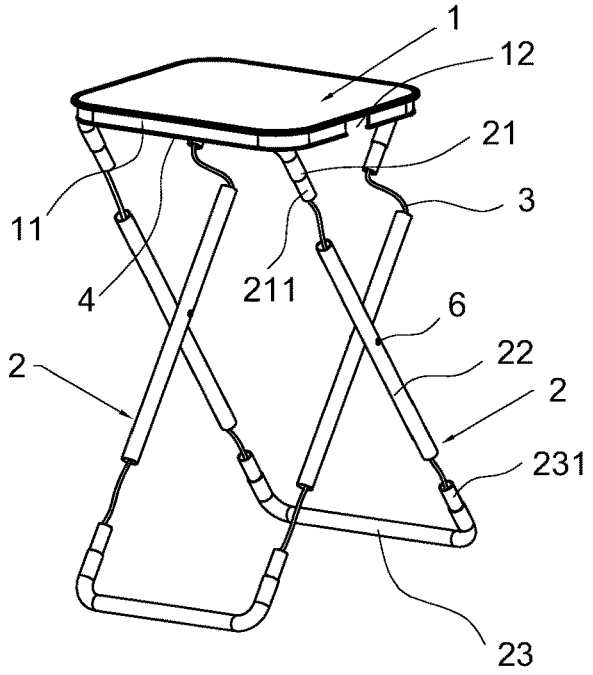
FIG. 3 is a perspective view of FIG. 1 when three sections of two pairs of support legs are disengaged.
Figure 4:
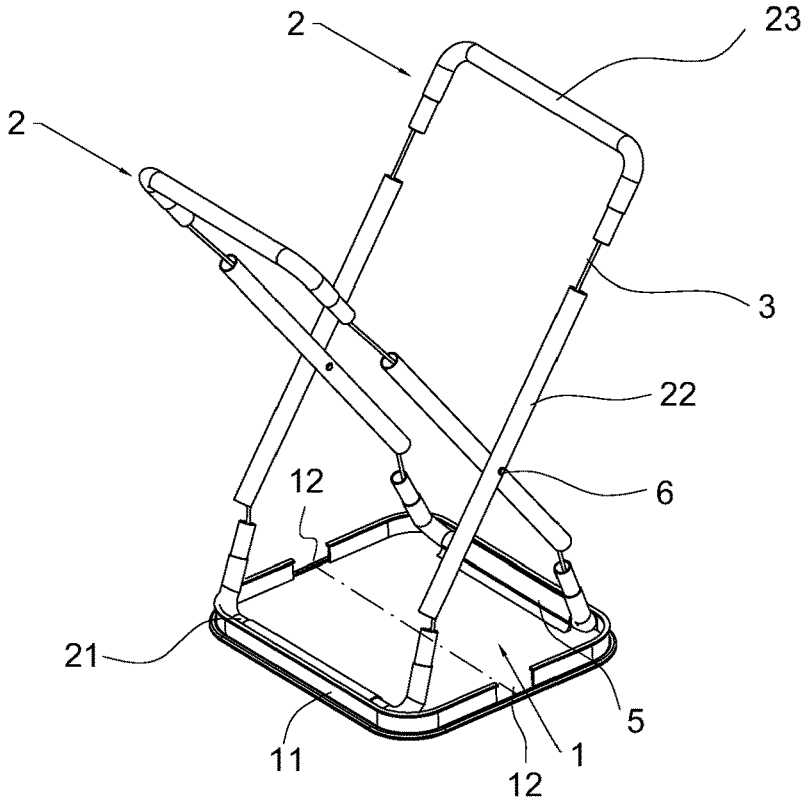
FIG. 4 is a perspective view of FIG. 2 when the three sections of the support legs are separated.
Figure 5:
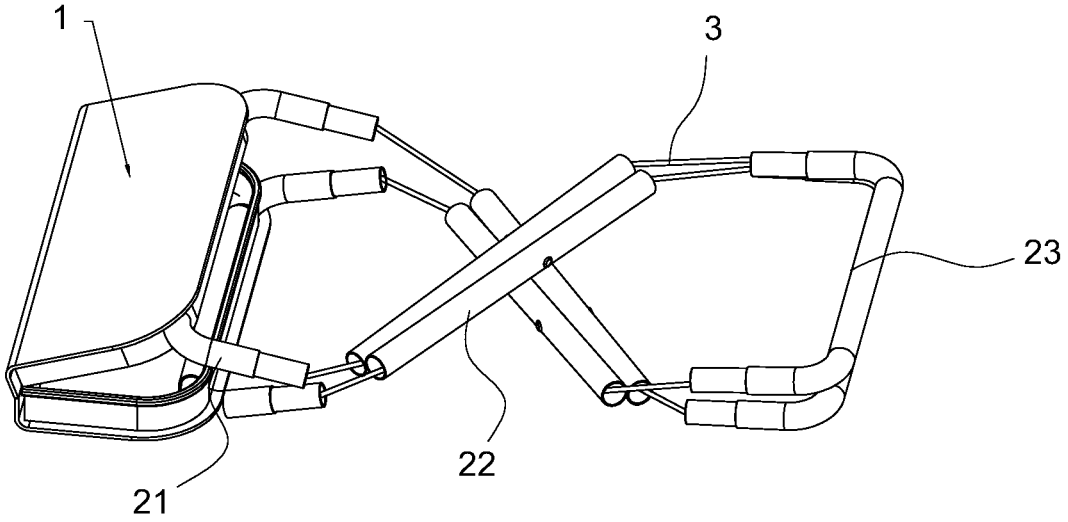
FIG. 5 is a perspective view of FIG. 3 after the stool surface is folded and the support legs are rotated.
Figure 6:
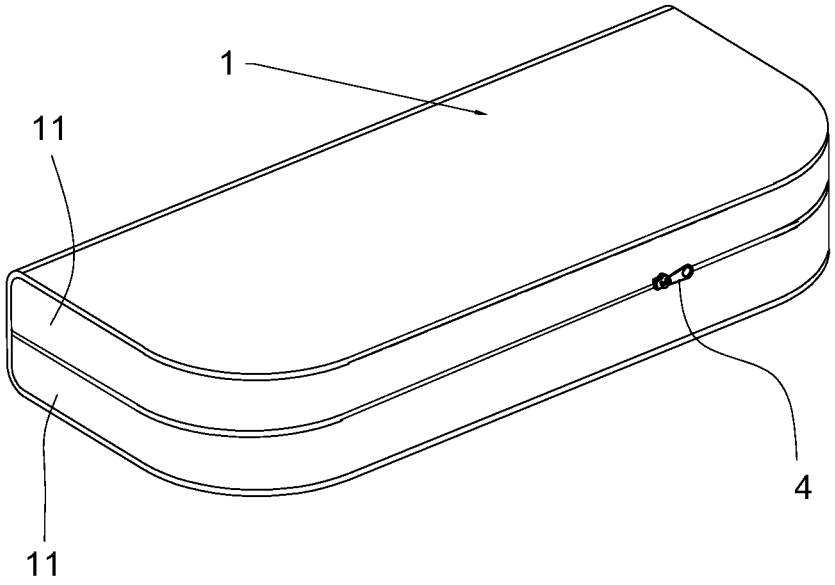
FIG. 6 is a perspective view of the foldable stool in a folded state according to the embodiment of the present invention.

When the stool is in use, the middle sections 22 of the support leg 2 are inserted into the corresponding upper section 21 and the corresponding lower section 23 forming a support leg 2, and the two sets of the support legs 2 are pulled open to form an X-shape, so that the stool surface 1 is unfolded for people to sit and use. When the stool needs to be stored after use, the middle sections 22 are pulled apart from the upper section 21 and the lower section 23, as shown in FIGS. 3 and 4, the stool surface 1 is folded in half, the middle sections 22 rotate by 90 degrees, the upper sections 21, the middle sections 22 and the lower sections 23 are folded and put into a storage bag formed by the stool surface 1, and finally, the bag is closed by the zipper 4, as shown in FIGS. 5 and 6.

Figure 7:
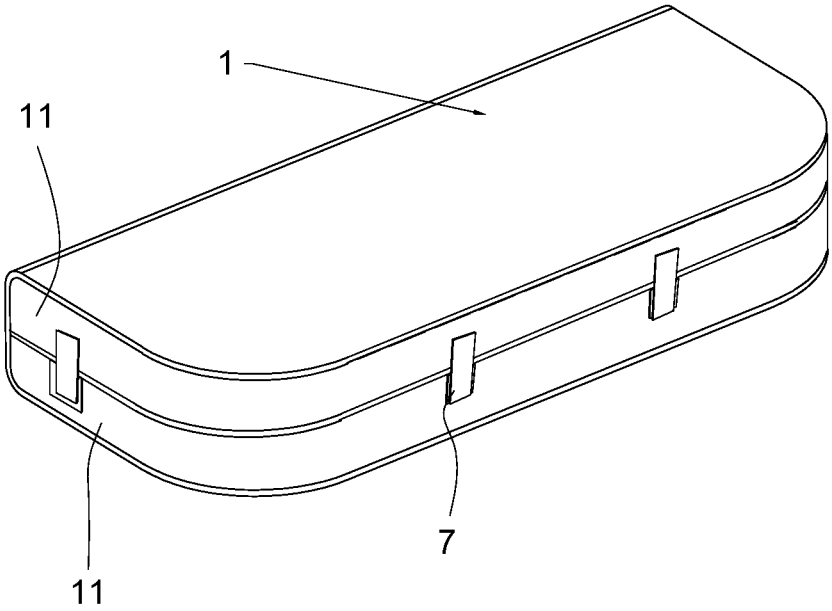
FIG. 7 is another perspective view of the foldable stool in a folded state according to the embodiment of the present invention.

In this embodiment, a detailed description is only made to a zipper design. In fact, similar technical effects can be used to replace the zipper 4, such as a hasp 7, a nylon hasp, as shown in FIG. 7.

The protection scope of the present invention is not limited to each embodiments described in this description. Any changes and replacements made on the basis of the scope of the present invention patent and of the description shall be included in the scope of the present invention patent.

The invention claimed is:

1. A foldable stool, comprising:

a stool surface having a bottom surface; and two support legs;

wherein, the stool surface is made of materials capable of being folded up to form a storage compartment for receiving the two support legs;

two support legs are rotatably connected to each other, the tops of the two support legs are respectively connected to the left side and right side of the bottom surface of the stool surface;

each support leg is made of tubes, each support leg is hollow inside and composed of an upper section, a middle section and a lower section connected together, the upper section and the lower section having a U-shape, the middle section being composed of two straight tubes each having a top end and a bottom end;

two ends of the upper section have a smaller diameter relative to the upper section so as to insert into the top end of each tube of the middle section, and two ends of the lower section have a smaller diameter relative to the lower section so as to insert into the bottom end of each tube of the middle section, accordingly, the upper, middle and lower sections are detachably connected together to form a rectangular frame;

an elastic rope runs inside through each support leg, when the elastic rope is extended, the upper, middle and lower sections of the support leg are separated from each other and rotatably folded into the storage compartment formed by folding the stool surface.

2. The foldable stool of claim 1, wherein a connecting hole is disposed at the middle of each tube of the middle section, the middle section of one support leg is disposed outside of the other support leg, and the middle section of one support leg is rotatably connected to the middle section of the other support leg by two connecting pins inside the connecting holes, so as to make the two support legs be rotatably connected in an X shape.

3. The foldable stool of claim 1, wherein the stool surface is square or rectangular, the stool surface has a lower edge protruding from the bottom surface of the stool surface, and a zipper or a hasp is disposed on the lower edge.

4. The foldable stool of claim 3, wherein the tops of the support legs are disposed on the bottom surface of the stool surface and located at the inner side of the lower edge, and a plurality of connecting bands for securing the support legs are disposed adjacent to the lower edge on the bottom surface of the stool surface.

5. The foldable stool of claim 4, wherein the connecting bands are made of flexible materials, one end of each connecting band is fixed with the bottom surface of the stool surface, and the other end of each connecting band is fixed with the bottom surface of the stool surface after going around the upper section of one support leg.

6. The foldable stool of claim 2, wherein each support leg has two elastic ropes with two ends being positioned and fixed by the connecting pins;

the two elastic ropes are disposed in two opposite U-shaped routes in the upper, middle and lower sections of each support leg.

7. The foldable stool of claim 3, wherein the lower edge has two slots adjacent to a folding line of the stool surface.

* * * * *